United States Patent [19]

Nishimura

[11] Patent Number: 4,969,637

[45] Date of Patent: Nov. 13, 1990

[54] WORK HOLDER FOR VICE

[75] Inventor: Akira Nishimura, Kanazawa, Japan

[73] Assignee: Kabushiki Kaisha Nishimura JIG, Kanazawa, Japan

[21] Appl. No.: 417,440

[22] Filed: Oct. 4, 1989

[30] Foreign Application Priority Data

Dec. 26, 1988 [JP] Japan ..... 63-330531

[51] Int. Cl.[5] ..... 22B 1/10

[52] U.S. Cl. ..... 269/110; 269/271; 269/155

[58] Field of Search ..... 269/155, 240, 244, 257, 269/259, 262, 271, 279, 280, 282, 152, 134, 110; 408/103, 108; 409/225, 903

[56] References Cited

U.S. PATENT DOCUMENTS

| | | | |
|---|---|---|---|
| 1,071,289 | 8/1913 | Boder | 269/280 |
| 1,961,036 | 5/1934 | Boyle | 269/282 |
| 2,643,563 | 6/1953 | Gaudrau | 269/280 |
| 3,502,319 | 3/1970 | Kazolias | 269/280 |
| 4,383,682 | 5/1983 | Feinberg | 269/283 |
| 4,671,500 | 6/1987 | Mark | 269/134 |
| 4,736,934 | 4/1988 | Grech | 269/110 |
| 4,750,722 | 6/1988 | Chick | 269/271 |

FOREIGN PATENT DOCUMENTS

| | | | |
|---|---|---|---|
| 2060412 | 6/1971 | Fed. Rep. of Germany | 269/271 |

*Primary Examiner*—Robert C. Watson

*Attorney, Agent, or Firm*—Oblon, Spivak, McClelland, Maier & Neustadt

[57] ABSTRACT

The present invention relates to a work holder for a vice in a machine tool, in which by means of a holder body attached removably to a fixed jaw of the vice and a clamp block and a clamp screw both attached to the holder body, a work whose side faces have already been machined is fixed temporarily in an exact vertical posture and then fixed completely by the vice so that the side faces thereof are set exactly at right angles to permit machining for the top face of the work.

6 Claims, 3 Drawing Sheets

WORK HOLDER FOR VICE

BACKGROUND ART

The present invention relates to a work holder for a vice to be used for realizing the perpendicularity of a work machining face relative to a reference face of a machine tool in a simple manner at the time of machining a work while holding the work with the vice in the machine tool.

In machining a work by a machine tool such as a milling machine, there is widely used a vice for holding the work in a predetermined posture.

A vice is provided with a fixed jaw and a movable jaw opposed to the fixed jaw and movable back and forth, and it can sandwich a work in between both jaws. A mouthpiece finished to a predetermined shape with a high accuracy is attached to the inner surface side of each jaw so that the work can be fixed in a correct posture.

According to such prior art, the work can be set upright easily in the fore-and-aft moving direction of the movable jaw of the vice by enhancing the accuracy of the mouthpiece. However, no effective means have heretofore been available for restricting the tilting of the work in a face perpendicular to the fore-and-aft moving direction of the movable jaw. Thus, there has been the problem that it is difficult to set the work posture in an exact upright posture in the direction in question. Under the circumstances, for fixing the work, it has been necessary to perform the operations of first placing a guide gauge on the work table which fixes the vice, then setting the work along the gauge and thereafter tightening the vice. Thus, not only is the working procedure complicated but also there is the likelihood of tilting of the work at the time of tightening of the vice, resulting in deterioration of the work machining accuracy. Besides, the inconvenience that the above operations require a high degree of skill has also been unavoidable.

DISCLOSURE OF THE INVENTION

The present invention has been accomplished in view of the above-mentioned circumstances of the prior art, and it is the object thereof to provide a work holder for a vice which is capable of being attached to the vice beforehand and restricting the work posture effectively in a face perpendicular to the fore-and-aft moving direction of a movable jaw and which permits even an unskilled worker to fix a work to a predetermined upright posture easily and firmly.

V . . . vice, $V_1$ . . . fixed jaw,

DETAILED DESCRIPTION OF THE INVENTION

A typical embodiment of the present invention will be described hereinunder with reference to the drawings.

Figure 1:
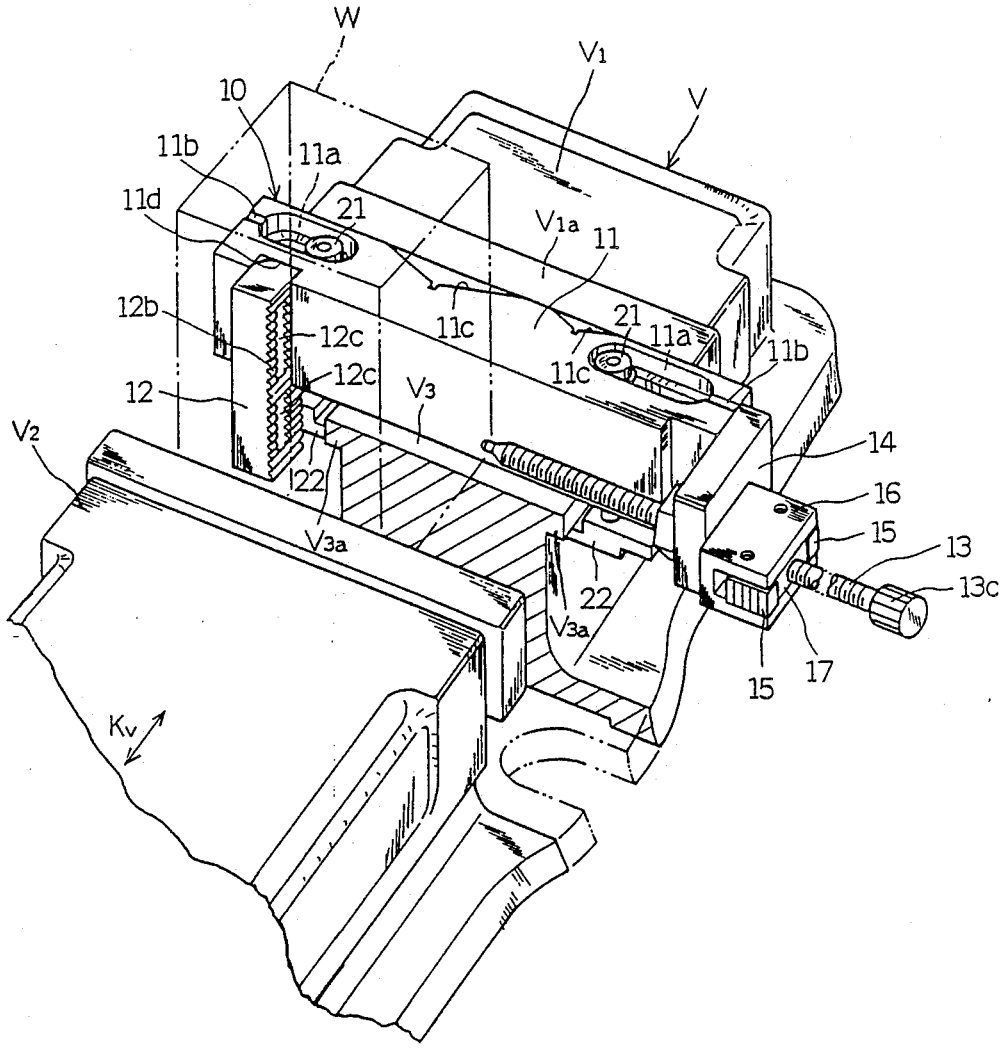
FIG. 1 is an explanatory perspective view showing a holder according to a typical embodiment of the present invention.

As shown in FIG. 1, a work holder for a vice (hereinafter referred to simply as the "work holder") 10 includes as main constituent members a holder body 11, a clamp block 12 and a clamp screw 13. The work holder 10 is attached to the front face of a fixed jaw $V_1$ of a vice V and is used for holding a work W in a predetermined posture between it and a movable jaw $V_2$.

The holder body 11 is in the form of a quadrangular prism a little longer than the front face of the fixed jaw $V_1$ of the vice V, and in both end portions thereof there are formed stepped (see FIG. 2), elongated holes 11*a*, 11*a* for retaining bolt heads. Further, between the elongated holes 11*a*, 11*a* and both end faces of the holder body 11 there are formed shallow slots 11*b*, 11*b*, . . . . The shallow slots 11*b*, 11*b*, . . . are formed in the upper and lower surfaces of the holder body 11 in positions aligned with the central axes of the elongated holes 11*a*, 11*a*. In the rear side face of the holder body 11 there are formed large and small V grooves 11*c*, 11*c* which are each continuous in the vertical direction. In one end portion of the front side of the holder body 11 there is formed a square slot 11*d* in the vertical direction for mounting the clamp block 12 therein (see FIGS. 1 and 3).

Figure 3:
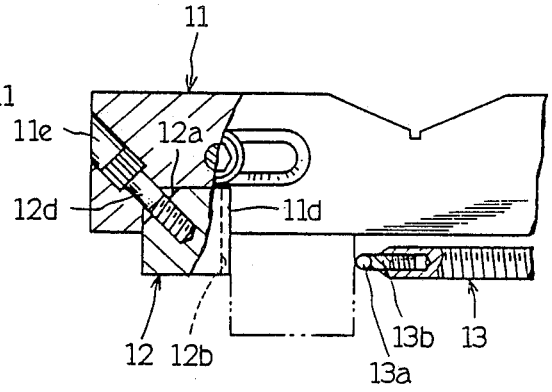
FIG. 3 is a partially cut-away plan view of the holder illustrated in FIG. 1.

The clamp block 12 has a large chamferred portion 12*a* formed on its rear side, rack grooves 12*b* formed in its inner side face, and elongated holes 12*c*, 12*c* formed in its central portion. As shown in FIG. 3, the clamp block 12 is fitted in the square slot 11*d* of the holder body 11 threadedly through a mounting bolt 12*d*. The vertical length of the clamp block 12 is larger than the height of the holder body 11 and hence its lower end portion projects downwards beyond the underside of the holder body 11.

Figure 4:
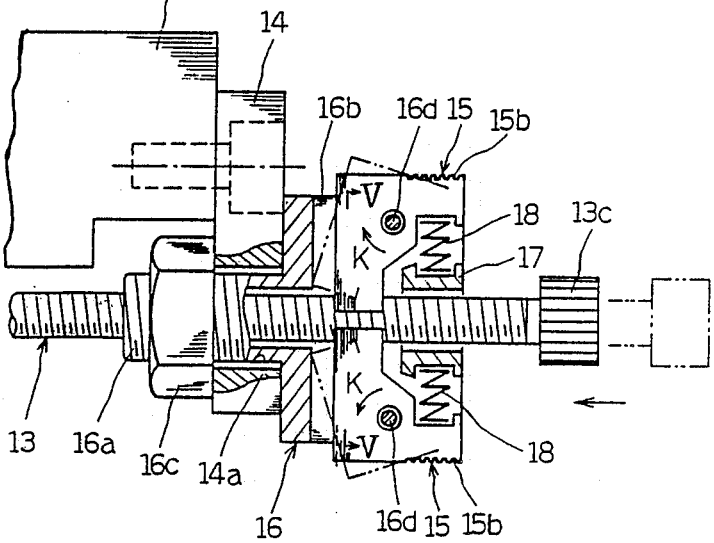
FIG. 4 is a view explanatory of assembling main components of the holder illustrated in FIG. 1.

On the other hand, as shown in FIG. 4, the clamp screw 13 is attached to one end face of the holder body 11 through a base 14 and a pair of movable blocks 15, 15. It is constituted so as to be movable forward and backward with respect to the clamp block 12. The movable blocks 15, 15 are supported pivotably by a holder 16.

The clamp screw 13 is a long screw rod-like member having a small screw 13*b* with a rotatable steel ball 13*a* at the tip thereof (see FIG. 3), and its rear end is formed with a knurled knob portion 13*c*.

As shown in FIG. 4, the base 14 is mounted to one end face of the holder body 11 threadedly through mounting bolts (not shown). On the other hand, the holder 16 comprises a cylindrical portion 16*a* having external threads and a ⊐-shaped, movable block receptacle portion 16*b*. The cylindrical portion 16*a* extends through a through hole 14*a* of the base 14 and is fixed to the base 14 through a nut 16*c*.

Figure 5:
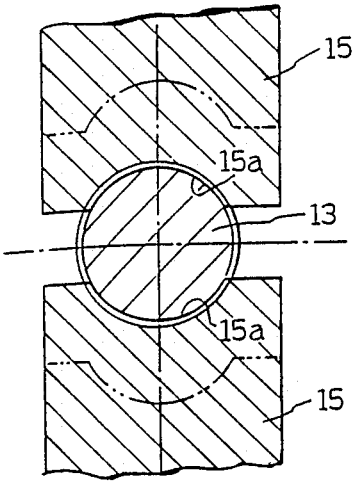
FIG. 5 is a sectional view taken on line V—V of FIG. 4.

The movable blocks 15, 15 are disposed so as to sandwich the clamp screw 13 in between them from both sides and are supported by the holder 16 pivotably through fixed pins 16*d*, 16*d*. The inner surface sides of the movable blocks 15, 15 are formed with internal threads 15*a*, 15*a* for engagement with the clamp screw 13, as shown in FIG. 5. Further, inside the movable blocks 15, 15 there are mounted compression springs 18, 18 (see FIG. 4) in abutment with a spacer member 17 through which the clamp screw 13 extends. The compression springs 18, 18 urge the blocks 15, 15 in directions (opposite to arrows K in the same figure) to keep them closed. In the outer surfaces of the movable blocks 15, 15 there are formed serrations 15*b*, 15*b*.

The clamp screw 13 extends through a through hole formed in the spacer member 17 and is threadedly engaged with the internal threads 15*a*, 15*a* of the movable members 15, 15, then extends through the cylindrical portion 16*a* of the holder 16. It is mounted movably forwards and backwards.

Figure 2:
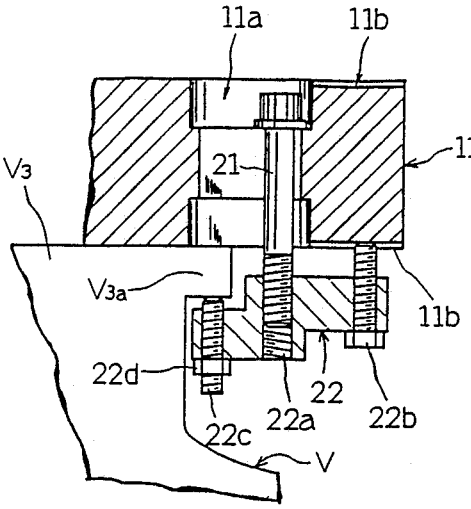
FIG. 2 is a sectional view showing a principal portion of the holder illustrated in FIG. 1.

The work holder 10 of the above construction is mounted to the fixed jaw $V_1$ of the vice V by using mounting bolts 21, 21 and fixing block pieces 22, 22, as shown in FIG. 2. More specifically, the mounting bolts 21, 21 are inserted vertically into the elongated holes 11*a*, 11*a* of the holder body 11, and on the lower surface side of the holder body 11 those mounting bolts are threadedly inserted into threaded holes 22*a*, 22*a* of the fixing block pieces 22, 22 to thereby fix the holder body 11 onto a slide bed $V_3$ of the vice V.

Positioning bolts 22*b* and adjusting bolts 22*c* are inserted and projected through the fixing block pieces 22, 22 upwards from below. The tips of the former get into the slots 11*b* formed in the lower surface of the holder body 11 to position the fixing block pieces 22, while the tips of the latter bolts are brought into abutment with the lower surfaces of overhang portions $V_{3a}$ projecting from both sides of the slide bed $V_3$, thus permitting the holder body 11 to be fixed by the mounting bolts 21, 21. The height of the adjusting bolts 22*c* are adjusted by stop nuts 22*d*, so that the fixing block pieces 22 can be kept nearly horizontal in conformity with the thickness of the overhang portions $V_{3a}$. In this way, when mounting the work holder to the vice V, the rear side face of the holder body 11 is brought into completely close contact with the front mouthpiece indicated at $V_{1a}$ of the fixed jaw $V_1$.

Then, a square rod-like work W is placed in front of the holder body 11. It is here assumed that the vertical side faces of the work W have already been subjected to machining as reference faces and that the top face thereof is to be machined. In this case, the work W must be fixed so that its vertical side faces do not tilt in a face perpendicular to the fore-and-aft moving direction of the movable jaw $V_2$ (the direction of arrow Kv in FIG. 1).

The work W is held by hand so that one vertical side face thereof is pushed against a side face of the clamp block 12 and a side face adjacent to the said side face of the work is pushed against the front face of the holder body 11, then the clamp screw 13 is moved forward to fix the work temporarily.

On the other hand, the movable blocks 15, 15 which restrict the movement of the clamp screw 13 can be opened until disengagement of the respective inner surface-side internal threads 15*a*, 15*a* from the clamp screw 13 by holding the serrations 15*b*, 15*b* with fingertips from both outsides and applying thereto a force enough to compress the compression springs 18, 18 (that is, the movable blocks 15, 15 move in the directions of arrows K in FIG. 4 and reach the respective positions indicated by dash-double dot lines in FIGS. 4 and 5). Therefore, the clamp screw 13 can be advanced toward the work W freely without turning the knob portion 13*c* until the tip thereof comes into abutment with the work, whereupon, by releasing the fingertips from the movable blocks 15, 15, the movable blocks revert to their original positions (the solid line positions in FIGS. 4 and 5) by virtue of the compression springs 18, 18. Thereafter, by turning the knob portion 13*c*, the clamp screw 13 is moved forward, whereby the work W is pressed against a vertical face of the clamp block 12 to correct tilting of the work W in a face perpendicular to the fore-and-aft moving direction of the movable jaw $V_2$.

Subsequently, the movable Jaw $V_2$ is moved forward to hold and fix the work W firmly between the movable jaw and the holder body 11. At this time, even if a gap is formed between the work W and the front face of the holder body 11, tilting of the work W in the fore-and-aft moving direction of the movable jaw $V_2$ can be corrected forcibly because the work W is pushed against the holder body 11 by the movable jaw $V_2$. That is, the work W can be held exactly in a predetermined upright posture by the clamp block 12, movable jaw $V_2$ and holder body 11. Even if the work W moves by being pushed in the direction of the holder body 11 with the forward movement of the movable jaw $V_2$, this movement is very smooth and there is no fear of damage to the work W because the tip of the clamp screw 13 is in abutment with the work W through the rotatable steel ball 13*a*.

After machining of the work W, the work can be unloaded by moving the movable jaw $V_2$ backward and thereafter retreating the clamp screw 13 to release the work. By moving the movable blocks 15, 15 to their open positions, the clamp screw 13 is released at once from their restraint made by the internal threads 15*a*, 15*a* and thus can be retreated in a one-touch manner.

Figure 6:
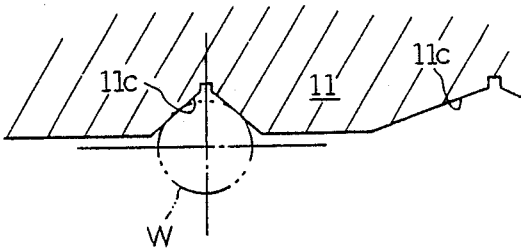
FIG. 6 is an explanatory sectional view showing another state of use of the holder illustrated in FIG. 1.

If the clamp block 12 is removed from the holder body 11 and then the holder body is turned upside down, the rear face-side V grooves 11*c*, 11*c* can be positioned on the front face side as shown in FIG. 6, so round rod-like works W can be held vertically by utilizing those V grooves. In the upper and lower surfaces of the holder body 11 there are formed the stepped, elongated holes 11*a*, 11*a* and the slots 11*b*, 11*b*, . . . symmetrically up and down, so even when the holder body 11 is turned upside down, it can be mounted to the vice V in just the same manner as above.

OTHER EMBODIMENTS

Figure 7:
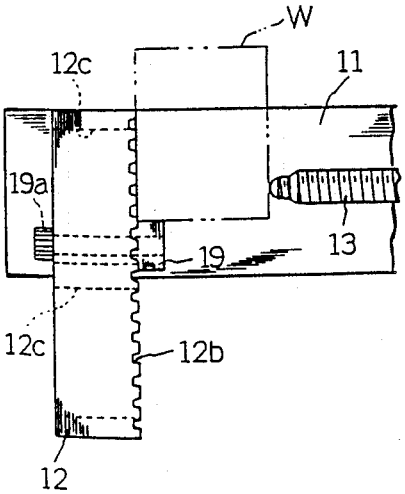
FIG. 7 is a partial side view showing a modification of the present invention.

To the inside face of the clamp block 12 there may be attached a stopper block 19 adapted for engagement with the rack grooves 12*b* as shown in FIG. 7. With a mounting bolt 19*a*, the stopper block 19 can be fixed to any desired vertical position of the clamp block 12 by utilizing the elongated holes 12*c*, 12*c*. Since the falling of the work W can be prevented by the stopper block 19, even a work W of a small vertical length can be held easily in a predetermined upright posture.

Figure 8:
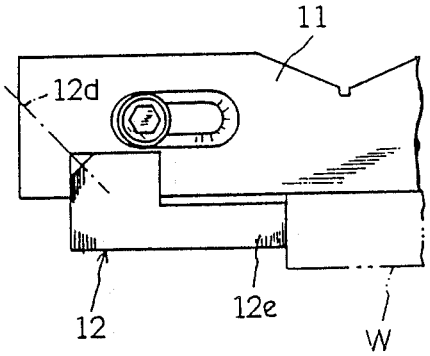
FIG. 8 is a partial plan view showing another modification of the present invention.

The clamp block 12 may have an extension 12*e* extending long along the front face of the holder body 11 as shown in FIG. 8. By determining the length of the extension 12*d* optionally it becomes possible to grip the work W at the central portion of the vice V, so a tilting force is scarcely exerted on the movable jaw $V_2$; that is, there is no fear of damage to the vice V.

Since the work W can be fixed temporarily by utilizing the clamp screw 13, the work holder 10 can be used also for holding plural works W, W, . . . of the same thickness simultaneously with respect to the vice V.

In the work holder of the present invention constructed as above, when the holder body is to be mounted to the front face of the fixed jaw of the vice, since the clamp block is disposed vertically upright between the holder body and the movable jaw, a work can be fixed temporarily to a predetermined upright posture defined with the clamp block by holding the work manually in a state of abutment of one side face thereof with the clamp block and causing the clamp screw to move forward. Thereafter, by moving the movable jaw forward, the work can be sandwiched in between the holder body and the movable jaw. Thus, the work can be positioned and fixed to an upright posture in a simple manner.

Moreover, by mounting the stopper block to the clamp block, even a work of a small vertical length not reaching the slide bed of the vice can be fixed temporarily by the clamp block, stopper block and clamp screw. In this case, since the clamp block and the stopper block are formed with rack grooves, there is no fear of tilting of the stopper block which would lead to tilting of the work.

Further, when a pair of movable blocks are provided with respect to the clamp screw, by moving the movable blocks to the respective open positions the clamp screw can be moved forward and backward freely without being restricted by its screw pitch, thus resulting in that the time required for the temporarily fixing operation for the work of the work removing operation can be greatly shortened.

Additionally, if V grooves are formed on the rear face side of the holder body, then by opposing the rear face to the movable jaw it becomes possible to hold round rod-like works, using the V grooves.

What is claimed is:

1. A work holder for a vice for loading a work to the vice while holding the work in a vertical posture, said work holder including:

a holder body in the form of a quadrangular prism to be mounted removably on the front side of a fixed jaw of the vice;

a clamp block fixed vertically upright on the front side of said holder body; and a clamp screw capable of moving forward and backward with respect to a work holding face of said clamp block;

wherein said clamp screw is threadedly engaged with a pair of movable blocks each having internal threads on the inner surface side thereof and supported pivotably by a pin, said movable blocks being held in closed positions to sandwich said clamp screw in between them and pivotable to open positions for disengagement from said clamp screw.

2. A work holder for a vice according to claim 1, wherein the work holding face of said clamp block is formed with rack grooves and which is further provided with a stopper block capable of being attached to the work holding face of said clamp block in any desired vertical position.

3. A work holder for a vice according to claim 1, wherein a vertically extending V groove is formed in the side face of said holder body opposite to the side face thereof where said clamp block is disposed.

4. A work holder for a vice according to claim 1, wherein said holder body has a pair of stepped, elongated holes extending vertically through the holder body, said elongated holes each having vertically symmetric stepped portions, and a bolt is inserted through each of said elongated holes, the tip of said bolt being threadedly engaged with a clamp-shaped fixing block piece.

5. A work holder for a vice according to claim 1, wherein the tip of said clamp screw is provided with a small screw having a steel ball attached thereto.

6. A work holder for a vice according to claim 1, wherein said clamp block has an extension extending up to a central part of said holder body, said extension having a vertical end face for holding the work.

* * * * *